US007635817B2

(12) United States Patent
Asada

(10) Patent No.: US 7,635,817 B2
(45) Date of Patent: Dec. 22, 2009

(54) COMBINED SWITCH

(75) Inventor: Makoto Asada, Yao (JP)

(73) Assignee: Hosiden Corporation, Osaka (JP)

( * ) Notice: Subject to any disclaimer, the term of this patent is extended or adjusted under 35 U.S.C. 154(b) by 149 days.

(21) Appl. No.: 12/015,565

(22) Filed: Jan. 17, 2008

(65) Prior Publication Data

US 2008/0173522 A1 Jul. 24, 2008

(30) Foreign Application Priority Data

Jan. 19, 2007 (JP) ..... 2007-010609

(51) Int. Cl.
*H01H 19/58* (2006.01)

(52) U.S. Cl. ..... 200/14; 200/566

(58) Field of Classification Search ..... 200/4, 200/18, 14, 17 R, 5 R, 406, 564–571, 336
See application file for complete search history.

(56) References Cited

U.S. PATENT DOCUMENTS 6,111,208 A * 8/2000 Rochon et al. ..... 200/14
6,420,667 B1 * 7/2002 Miwa et al. ..... 200/4
6,570,105 B1 * 5/2003 Sallam et al. ..... 200/4
7,087,848 B1 * 8/2006 Yamasaki et al. ..... 200/6 A
7,262,373 B2 * 8/2007 Miura et al. ..... 200/4
7,439,460 B1 * 10/2008 Watson ..... 200/5 R

FOREIGN PATENT DOCUMENTS

| | | |
|---|---|---|
| JP | 11306918 | 11/1999 |
| JP | 2000331569 | 11/2000 |
| JP | 2003217402 | 7/2003 |
| JP | 2005100712 | 4/2005 |
| JP | 2005129301 A | 5/2005 |
| JP | 2006351218 A | 12/2006 |

* cited by examiner

*Primary Examiner*—Michael A Friedhofer
*Assistant Examiner*—Lisa N Klaus
(74) *Attorney, Agent, or Firm*—The Webb Law Firm

(57) ABSTRACT

A main body portion has fixed contacts and houses movable contacts. A lower electrode plate and upper electrode plate serving as the movable contacts are deformed at a time of a pressing operation. The upper electrode plate is contactable to the lower electrode plate and lower electrode plate brings contact pairs mounted in a center of the bottom inside the main body portion into conduction. On the bottom inside the main body portion, contacts serving as fixed contacts for a rotating operation are formed on the circumference of the same circle outside contact pairs for the pressing operation. A brush serving as the movable contacts is secured to a lever receiving rotating operational forces and brings contacts into conduction.

6 Claims, 9 Drawing Sheets

COMBINED SWITCH

BACKGROUND OF THE INVENTION

1. Field of the Invention

The present invention relates to a combined switch obtained by combining a push switch to be activated by a pressing operation and a rotary switch by a rotating operation.

2. Description of the Related Art

A conventional combined switch is already known which has tried to achieve a decrease in a component count and mounting area by providing the switch with a plurality of switch functions. Such a combined switch is used for the integration of a photographic mode changing switch and/or zoom switch with a shutter, for example, in a film camera, digital camera, or a like.

Such combined switches as above are disclosed in, for example, JP2000-331569 (Patent Reference 1, $18^{th}$ to $26^{th}$ paragraphs and the like) and JP11-306918A (Patent Reference 2, $12^{th}$ to $23^{rd}$ paragraphs and the like).

The combined switch disclosed in the Patent Reference 1 is realized by combining a tactile switch (push switch) and a rotary switch. In a base main body of the combined switch, fixed contacts for the tactile switch and fixed contacts for the rotary switch are formed. The contacts for the rotary switch are made up of one common fixed contact and nine fixed contacts. The common fixed contact is formed in a manner to be extended along a circle whose center is a central point of the base main body. The remaining nine fixed contacts are formed at equal intervals along one of concentric circles whose radius is larger than that of another of concentric circles serving as a reference circle for the common fixed contact.

The combined switch disclosed in the Patent Reference 2 is realized by combining a multidirectional switch and a rotary switch. The fixed contacts of the rotary switch are made up of eight contact portions and one common contact portion. The eight contact portions are positioned apart from one another approximately annularly. The common contact portion is formed approximately annularly in an inside portion surrounded by these eight contact portions.

SUMMARY OF THE INVENTION

The combined switches disclosed in the above Patent References 1 and 2 are useful in that such switches each having a different function are integrated into one switch. However, in the rotary switch mounted in, for example, such combined switches disclosed above, one common fixed contact is disposed on the circumference of a circle and other fixed contacts are disposed on the circumference of a different circle. As a result, in order to constitute the rotary switch, an additional area corresponding to an outside circle making up the double circles is required, which inhibits the miniaturization of the combined switch. These conventional combined switches are practically trying to make a switch more smaller in size and in mounting area and, therefore, still further miniaturization is expected to attain the object.

In view of the above, it is an object of the present invention to provide a combined switch which is capable of achieving easy assembly and a decrease in mounting area.

To attain the above object, the combined switch made up of a push switch to be activated by a pressing operation and a rotary switch by a rotating operation is configured to includes:

a main body portion having fixed contacts for the push switch and the rotary switch and housing movable contacts for the push switch and the rotary switch;

contact pairs for the push switch serving as the fixed contacts for the push switch mounted in a center of the bottom inside the main body portion;

a lower electrode plate serving as the movable contacts for the push switch having elastic forces and being deformed at a time of a pressing operation to bring the contact pairs for the push switch into conduction;

an upper electrode plate serving as the movable contacts for the push switch having elastic forces and being deformed at a time of a pressing operation to be contactable to the lower electrode plate;

a lever for the rotary switch to receive rotating operating forces;

a plurality of contacts for the rotary switch serving as the fixed contacts for the rotary switch mounted on the bottom inside the main body portion; and a brush being secured to the lever and serving as the movable contacts for the rotary switch to bring two contacts out of the plurality of contacts for the rotary switch into conduction according to a rotating operation on the lever.

The contacts for the rotary switch of the combined switch have one common contact to be electrically connected to the brush irrespective of a rotating operation of the lever and a plurality of individual contacts each being electrically connected to the common contact through the brush according to rotating operations at least at two stages in both rotating directions from a neutral position of the lever.

Also, the common contact and the individual contacts of the combined switch are formed on the circumference of the same circle outside the contact pairs for the push switch on the bottom inside said main body portion.

Also, the brush of the combined switch has a plurality of contactors sliding on the circumference of the same circle on which the contacts for the rotary switch are formed to bring the common contact and the individual contacts into conduction.

In the rotary switch mounted in the conventional combined switches disclosed above, one common fixed contact for the rotary switch is disposed on the circumference of a circle and other fixed contacts (individual contacts) are disposed on the circumference of a different circle. Therefore, in order to constitute the rotary switch, an additional area corresponding to an outside circle making up the double circles is required, which causes a limit to the miniaturization of the combined switch. However, according to the present invention, contacts for the rotary switch are formed on the circumference of the same circle. Therefore, unlike in the conventional technology, when the rotary switch is constituted, no additional area corresponding to the outside circle making up the double circles is required, thus enabling the miniaturization of the combined switch. As a result, the combined switch having a less mounting area can be provided.

Moreover, the body portion includes fixed contacts for the push switch and the rotary switch, and houses movable contacts for the push switch and the rotary switch. The fixed contacts and movable contacts are positioned within the main body portion, thereby making it easy to assemble the combined switch.

Also, the brush of the combined switch of the present invention has at least four said contactors corresponding to rotating operations at least at two stages in both rotating directions from a neutral position of said lever. Two contactors out of the four contactors come into contact with corresponding individual contacts out of the individual contacts at a time of a rotating operation at the second stage in the both rotating directions and come into contact with the common contact at a time of a rotating operation at any other stage.

A plurality of contactors of the brush is formed on the circumference of the same circle in a manner to correspond to contacts for the rotary switches disposed on the circumference of the same circle. The brush of the conventional combined switch has contactors for contacts on a circle on an inner circumference side and contactors for contacts on a circle on an outer circumference side in a manner to correspond to contacts having a concentric circle shape. According to the present invention, the two contactors out of a plurality of contactors formed on the circumference of the same circle are made to provide concurrent functions of contacting with the common contacts and contacting with individual contacts. Therefore, it is made possible to effectively bring the common contacts and individual contacts into conduction on the circumference of the same circle, thus achieving the miniaturization of the combined switch.

The combined switch of the present invention further includes;

an insulating cover on a periphery of which positioning portions are formed to be positioned when the positioning portions strike to come into contact with ribs formed in the main body portion to cover the upper electrode plate; and a frame to secure the insulating cover by interposing the insulating cover between the frame and the main body portion, wherein the positioning portions may be formed as slit-shaped incisions and, at this point of time, are struck by the ribs passing through the incisions to come into contact with the ribs. Also, the positioning portions may be formed as notches being opened toward a portion surrounding the positioning portions.

By configuring as above, the positioning portions of the insulating cover are struck by the ribs of the main body portion to come into contact and the insulating cover is sandwiched between the frame and the main body portion, which secures the insulating cover. Therefore, it is not necessary that a pressing margin of the insulating cover for the frame is provided, which enables the combined switch to be made smaller. Moreover, the positioning portions may be formed, as line-shaped or slit-shaped incisions, in a portion surrounding the insulating cover. Also, the positioning portions may be formed, as notches (concave portions) cut from a periphery to a center, in a portion surrounding the insulating cover. In the case of the insulating cover having the notches, the insulating cover can be positioned by making the notches strike the ribs of the main body portion to come into contact from a center side being at least one side in a diameter direction of the insulating cover. In the case of insulating cover having the incisions, the insulating cover can be positioned by making the incisions strike the ribs of the main body portion to come into contact from a plurality of directions in a diameter direction of the insulating cover.

Also, the combined switch of the present invention is configured so that the upper electrode plate is formed so as to extend from its peripheral portion and includes leg portions electrically connected to terminals formed in the main body;

wherein the brush includes a circular annular fixed portion are secured to the lever and supported by the main body, and contactors formed along a portion surrounding the fixed portion and being in contact with contacts for the rotary switch; and wherein the leg portions of the upper electrode plate and the fixed portion are placed so as to overlap in a direction of a pressing operation on the push switch.

By configuring as above, the leg portions of the upper electrode plate and the fixed portion are placed so as to overlap in a direction of a pressing operation on the push switch. Therefore, the combined switch can be configured without being extended in a diameter (horizontal) direction of the rotary switch. As a result, the miniaturization of the combined switch can be achieved.

BRIEF DESCRIPTION OF THE DRAWINGS

The above and other objects, advantages, and features of the present invention will be more apparent from the following description taken in conjunction with the accompanying drawings in which.

DETAILED DESCRIPTION OF THE PREFERRED EMBODIMENTS

Best modes of carrying out the present invention will be described in further detail using embodiments with reference to the accompanying drawings.

One Embodiment

Figure 1:
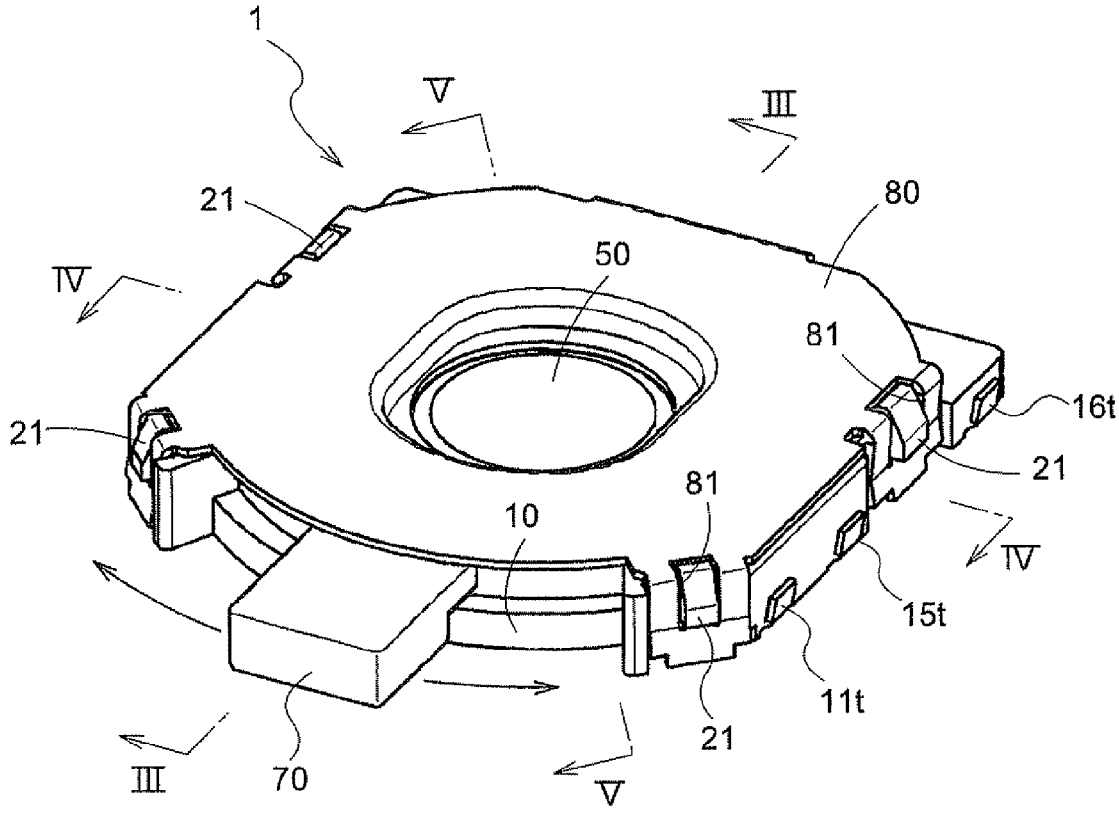
FIG. 1 is a perspective view of a combined switch according to one embodiment of the present invention.
Figure 2:
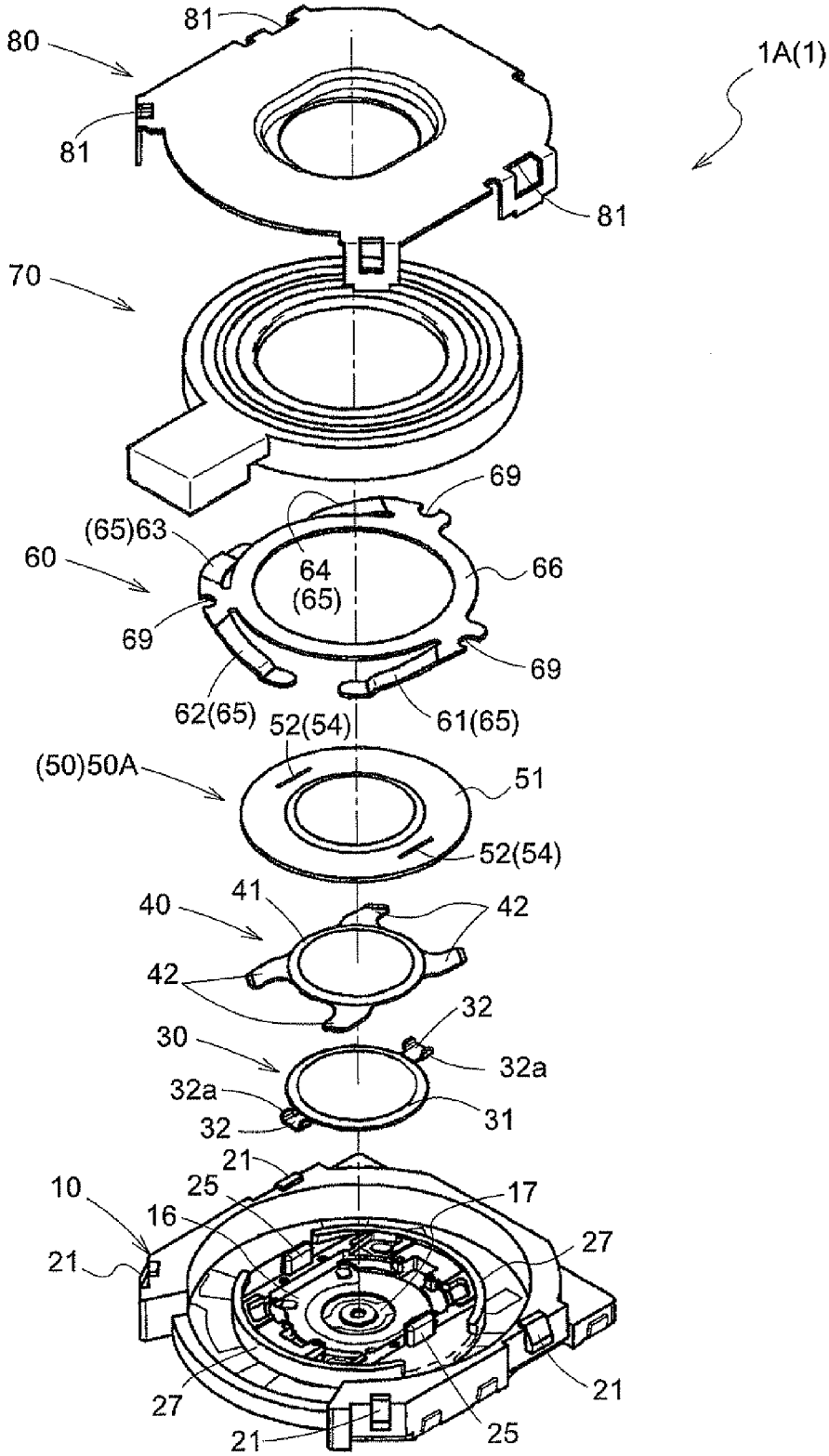
FIG. 2 is an exploded perspective view of the combined switch according to the embodiment of the present invention.
Figure 3:
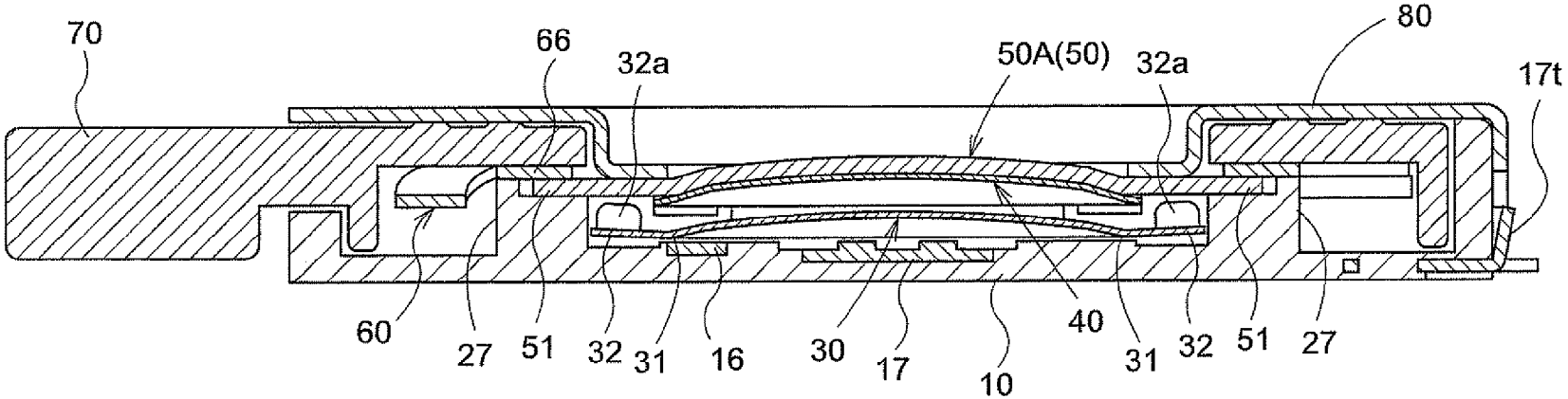
FIG. 3 is a cross-sectional view of the combined switch taken along the line III-III in FIG. 1.
Figure 4:
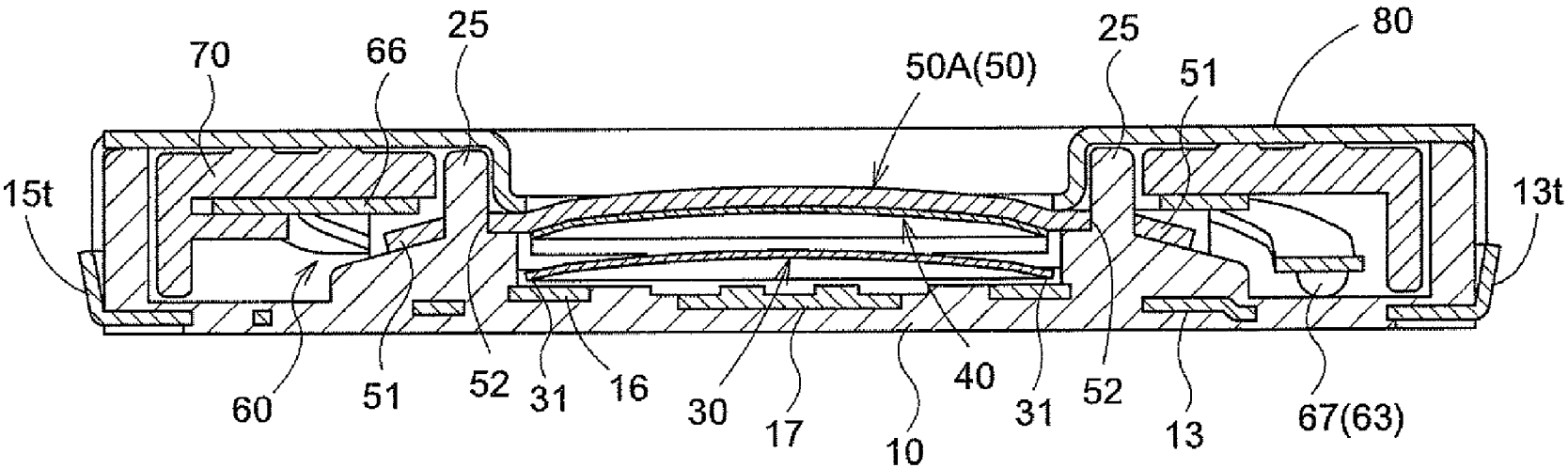
FIG. 4 is also a cross-sectional view of the combined switch taken along the line IV-IV in FIG. 1.
Figure 5:
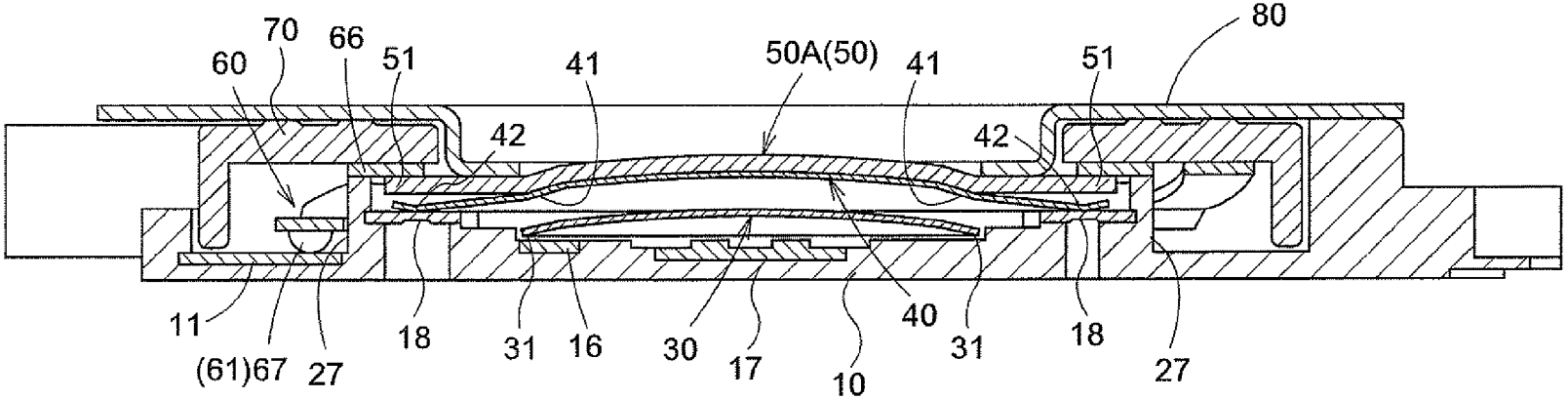
FIG. 5 is also a cross-sectional view of the combined switch taken along the line V-V in FIG. 1.

FIG. 1 is a perspective view showing a combined switch of an embodiment of the present invention. FIG. 2 is an exploded perspective view of the combined switch of the embodiment of the present invention. FIGS. 3 to 5 are a cross-sectional view of the combined switch of FIG. 1.

The combined switch 1 (1A) is a switch obtained by combining a push switch to be activated by a pressing operation and a rotary switch to be activated by a rotating operation. The combined switch 1 is mounted, for example, on a circuit board of a digital camera or a like and is configured to be covered by exterior components thereof. The exterior components make up an operating section having, for example, a mode switching function, zoom switching function, and shouter function in a combined manner.

As shown in FIG. 2 the combined switch 1 (1A) is so configured that a main body portion 10 is overlain successively by a lower electrode plate 30, an upper electrode plate 40, an insulating cover 50 (50A), a brush 60, a lever 70, a frame 80 and that associating nails 21 of the main body portion 10 are connected to associating holes 81 of the frame 80 in an associated manner.

The main body portion 10 is provided with fixed contacts for the push switch and rotary switch. And the main body portion 10 is configured so as to house movable contacts for the push switch and rotary switch. Here, the lower electrode plate 30 and upper electrode plate 40 serve as the movable contacts for the push switch. The brush 60 serves as the movable contact for the rotary switch.

In a center portion of an inside bottom of the main body portion 10 are formed contact pairs 16 and 17 for the push switch, as fixed contacts. The contact pairs 16 and 17 for the push switch are made up of a center contact 17 mounted in a center portion and an approximately annular lower permanent contact 16 which surround the center contact 17.

The lower electrode plate 30 is bowl-shaped. A peripheral portion 31 of the bowl-shaped lower electrode plate 30 is in contact with the lower permanent contacts 16. Two stopping portions 32 extend along a diameter direction from the peripheral portion 31. On the two stopping portions 32 are formed convex portions 32*a* projected upward. As shown in FIG. 3, when the convex portions 32*a* strike to come into contact with the frame 80 with the insulating cover 50 interposed between the convex portions 32*a* and the frame 80, the upward movement of the lower electrode plate 30 is restricted.

The lower electrode plate 30 has elastic forces. At a time of a pressing operation of the combined switch 1, a center portion of the bowl-shaped lower electrode plate 30 is deformed to come into contact with the center contact 17. This brings contact pairs 16 and 17 for the push switch made up of the lower permanent contact 16 and center contact 17 into conduction.

As shown in FIGS. 3 to 5, the upper electrode plate 40 is disposed so that there is specified clearance over the lower electrode plate 30. The upper electrode plate 40, as in the case of the lower electrode plate 30, is also bowl-shaped. Leg portions 42 are formed extending in four directions from the peripheral portion 41 of the upper electrode plate 40. As shown in FIG. 5, the leg portions 42 come into contact with fixed contacts (an upper permanent contact 18) in the main body portion 10.

The upper electrode plate 40 has elastic forces. At a time of a pressing operation of the combined switch 1, a center portion of the bowl-shaped upper electrode plate 40 is deformed to come into contact with the lower electrode plate 30. The pressing operation on the combined switch 1 is referred to as "the first stage pressing operation". By the first stage pressing operation, the upper permanent contact 18 and lower permanent contact 16 are brought into conduction through the upper electrode plate 40 and the lower electrode plate 30. This causes the combined switch 1 to get into an outputting state at the first stage of the push switch.

The outputting state can be detected through a terminal 16*t* electrically connected to the lower permanent contact 16 and a terminal 18*t* electrically connected to the upper permanent contact 18 (see FIG. 6 described later).

When pressing operational forces are further exerted on the combined switch 1, both the upper electrode plate 40 and lower electrode plate 30 are deformed. As described above, the lower electrode plate 30 comes into contact with the center contact 17. The pressing operation on the combined switch 1 is referred to as "the second stage pressing operation". By the second stage pressing operation, the upper electrode plate 40, lower electrode plate 30, upper permanent contact 18, lower permanent contact 16 and center contact 17 are brought into conduction. This causes the combined switch 1 to get into an outputting state at the second stage of the push switch.

Figure 6:
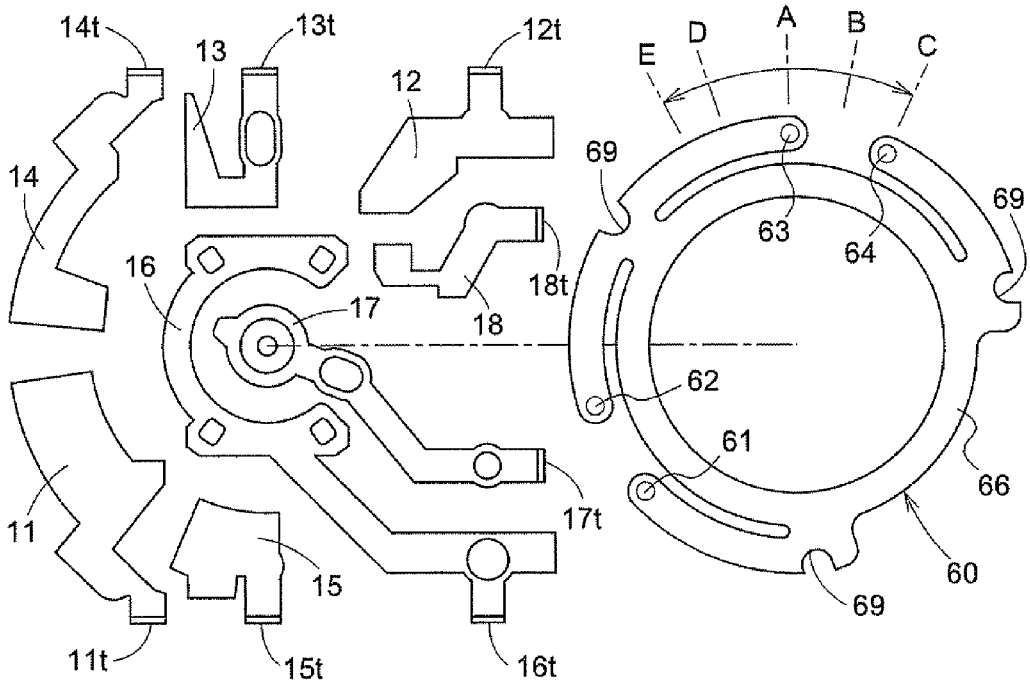
FIG. 6 is a diagram showing pattern examples of fixed contacts, examples of connection of terminals corresponding to each fixed contact obtained when a main body portion is seen from upside and examples of shapes of a brush mounted on the main body obtained when seen from an upside.

The outputting state can be detected through terminals 16*t* electrically connected to the lower permanent contact 16 and terminal 17*t* electrically connected to the upper permanent contact 17 (see FIG. 6). It is needless to say that, in addition to the above, the outputting state can be detected through terminal 18*t* electrically connected to the upper permanent contact 18.

Since the upper electrode plate 40 is deformed by the first and second stage pressing operations, the range of variation in its deformation is wider than that of the lower electrode plate 30. Due to this, the upper electrode plate 40 is so configured as to have the leg portions 42 which are made to deliver part of elastic forces. This enables the upper electrode plate 40 to avoid the degradation of life characteristics and operational characteristics and, as a result, degradation thereof in the upper electrode plate 40 is not so much compared with that in the lower electrode plate 30.

On the upper electrode plate 40 is placed the insulating cover 50 (50A) which covers the upper electrode plate 40. The insulating cover 50 is larger in diameter than the upper electrode plate 40 and is formed along its bowl-shaped surface of the upper electrode plate 40. In a portion 51 surrounding the insulating cover 50 are formed positioning portions 54. On the main body portion 10 are formed ribs 25 projected upward in places corresponding to the positioning portions 54. When the positioning portions 54 strike to come into contact with the ribs 25 formed in the main body portion 10, the insulating cover 50 is positioned.

In the portion 51 surrounding the insulating cover 50A are formed incisions 52 serving as the positioning portions 54. These incisions 52 may be formed to have a line shape or a slit-like shape. The ribs 25 in the main body portion 10 are formed in places corresponding to these incisions 52. When the ribs 25 pass through the incisions 52, the positioning of the insulating cover 50A is achieved (see FIG. 4). As shown in FIGS. 3 to 5, the insulating cover 50A (50) is secured in a state where the insulating cover 50A (50) covers the upper electrode plate 40 and is interposed between the main body portion 10 and the frame 80. The insulating cover 50 is made of a material such as rubber having elastic forces. The insulating cover 50 is deformed by the pressing operation on the combined switch 1 and is then restored to its original state.

A brush 60 is mounted above the upper electrode plate 40 and insulating cover 50. The brush 60 is mounted so as to be secured to a lever 70 placed further above the brush 60. The lever 70 receives operating forces. Then the lever 70 rotates the brush 60. The brush 60, as shown in FIG. 2, has circular annular fixed portions 66 and four contactors 65 (61 to 64) formed along the periphery of the fixed portions 66. In the fixed portions 66 of the brush 60 are formed notches 69 to be used for positioning. The notches 69 are connected to ribs (not shown) of the lever 70 for positioning in an associating manner. This causes the brush 60 to be positioned relative to the lever 70 and to be fixed thereto.

The fixed portions 66 of the brush 60 secured to the lever 70 is supported by flange portions 27 of the main body portion 10 (see FIGS. 2, 3 and 5). As shown in FIG. 5, the leg portions 42 of the upper electrode plate 40 and fixed portions 66 of the brush 60 overlap in both up and down directions of the combined switch 1. Therefore, an increase in size in a horizontal direction (diameter direction) can be suppressed thereby.

The frame 80 is disposed on the lever 70. As described above, the main body portion 10 is overlain successively by the lower electrode plate 30, upper electrode plate 40, insulating cover 50 (50A), brush 60, lever 70, and frame 80, and the associating nails 21 of the main body portion 10 are connected to the associating hole 81 of the frame 80 in an associated manner to assemble the combined switch 1 (1A). That is, it is made possible to very easily to assemble the combined switch 1 by sequentially overlying each of components and by finally connecting the main body portion 10 to the frame 80 in an associated manner.

Hereinafter, by referring to explanatory diagrams FIGS. 6 to 11, operations of the rotary switch are described. On a left side in FIG. 6, pattern examples of fixed contacts 11 to 18 and terminals 11*t* to 18*t* corresponding to fixed contacts 11 to 18 respectively obtained when the main body portion 10 is seen from an upside are shown. On a right side in FIG. 6, shape examples of the brush 60 mounted on the main body portion 10 obtained when seen from the upside are shown. The fixed contact patterns shown on the left side in FIG. 6 are overlain by the brush 60 with its posture shown in FIG. 6 being in a neutral position. When the contactor 63 is in an "A" position in FIG. 6, the brush 60 is in the neutral position. When the brush 60 is in any one of positions B to E shown in FIG. 6, the B position serves as the clockwise first stage, the C position serves as the clockwise second stage, the D position serves as the counterclockwise first stage and the E position serves as the counterclockwise second stage.

Figure 7:
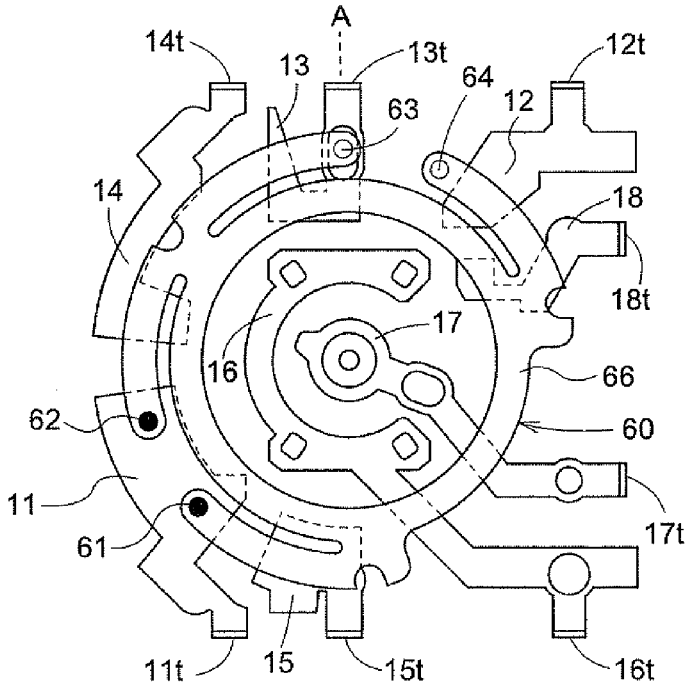
FIG. 7 is an explanatory diagram of operations (neutral position) of a rotary switch.
Figure 8:
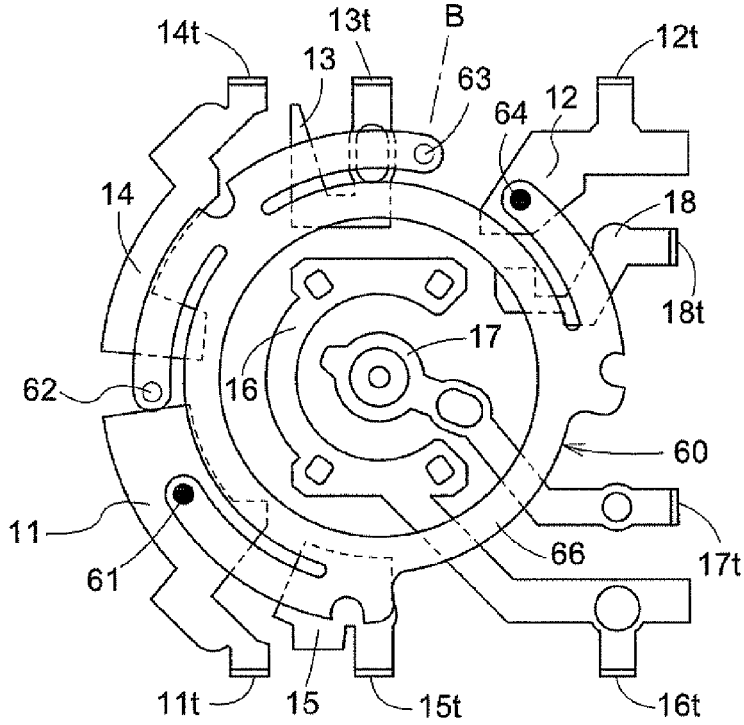
FIG. 8 is an explanatory diagram of operations (first stage clockwise) of the rotary switch.
Figure 9:
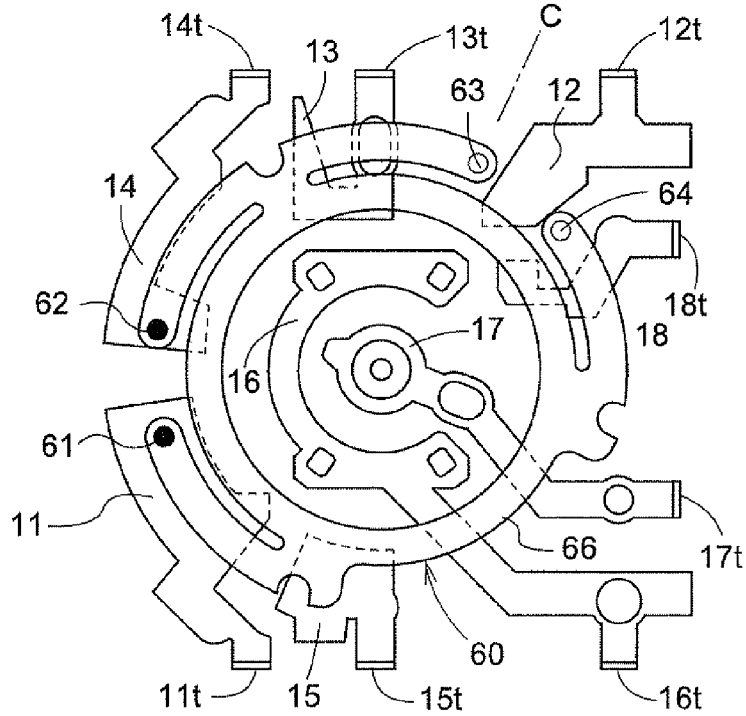
FIG. 9 is an explanatory diagram of operations (second stage clockwise) of the rotary switch.
Figure 10:
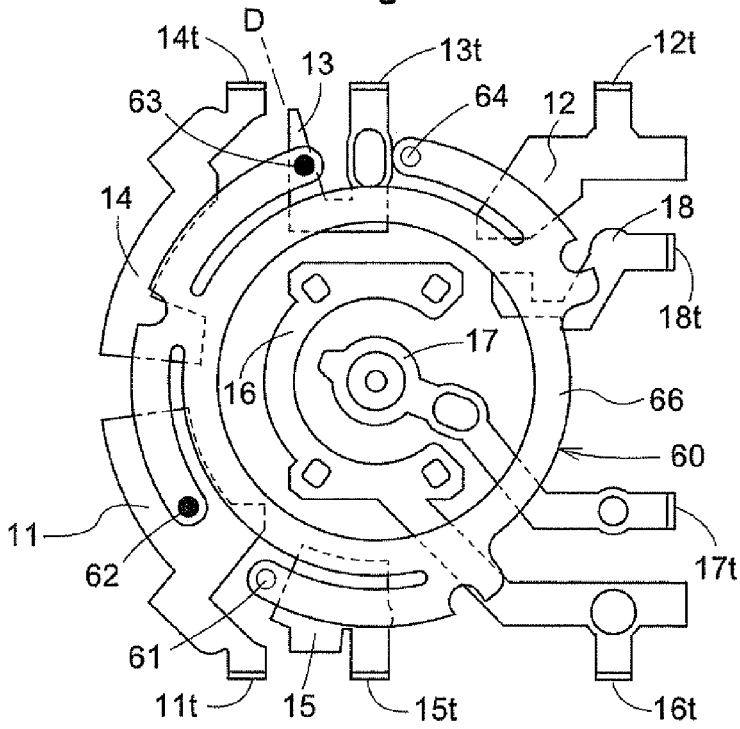
FIG. 10 is an explanatory diagram of operations (first stage counterclockwise) of the rotary switch.
Figure 11:
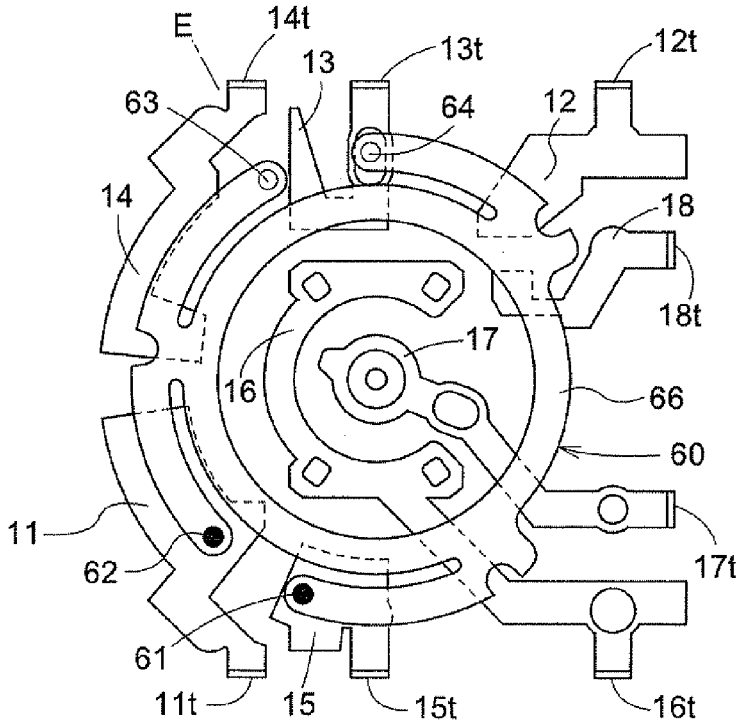
FIG. 11 is an explanatory diagram of operations (second stage counterclockwise) of the rotary switch.

In FIG. 7 to FIG. 11, examples are shown in which the fixed contacts 11 to 18 are overlain by the brush 60 in the above positions A to E. In FIG. 7, the lever 70 is in a neutral position and the brush 60 is also in the neutral position. In FIGS. 8 and 9, cases are shown in which the lever 70 is rotated to the first and second stages clockwise, which causes the brush 60 to be rotated according to the rotation of the lever 70. In FIGS. 10 and 11, cases are shown in which the lever 70 is rotated from the neutral position to the first and second stages counterclockwise. Similarly, the brush 60 is rotated according to the rotation of the lever 70.

The fixed contact 11 is one of contacts for the rotary switch serving as a common contact (for example, a ground) electrically connected, through the brush 60, to one of other contacts for the rotary switch. The fixed contact 12 is one of contacts for the rotary switch serving as an individual contact to be electrically connected, through the brush 60, when the lever 70 is rotated to the first stage clockwise, to the common contact 11. The fixed contact 13 is one of contacts for the rotary switch serving as an individual contact to be electrically connected, through the brush 60, when the lever 70 is rotated to the first stage counterclockwise, to the common contact 11.

The fixed contact 14 is one of contacts for the rotary switch serving as an individual contact to be electrically connected, through the brush 60, when the lever 70 is rotated to the second stage clockwise, to the common contact 11. The fixed contact 15 is one of contacts for the rotary switch serving as an individual contact to be electrically connected, through the brush 60, when the lever 70 is rotated to the second stage counterclockwise, to the common contact 11. The fixed contact 16 is one of contact pairs for the push switch and is a lower permanent contact 16 shown in FIGS. 2 to 5. The fixed contact 16 is electrically connected to the lower electrode plate 30 all the time. The fixed contact 17 is one of contact pairs for the push switch and is a center contact 17 shown in FIGS. 2 to 5. The fixed contact 18 is one of contacts for the push switch and is the upper permanent contact 18 shown in FIG. 5. The fixed contact 18 is electrically connected to the leg portions 42 of the upper electrode plate 40 all the time.

Each of the fixed contacts 11 to 18 is electrically connected to each of the terminals 11*t* to 18*t*. The terminals 11*t* to 18*t* are exposed toward the outside of the main body portion 10. By connecting the terminals 11*t* to 18*t* to printed circuit boards or the like, outputs from the combined switch 1 are transferred to electronic circuits on the printed circuit boards.

As shown in FIG. 2, the brush 60 has four contactors 65 (61 to 64). The mark 61 denotes the first contactor, the mark 62 denotes the second contactor, the mark 63 denotes the third contactor and the mark 64 denotes the fourth contactor. As shown in FIG. 4, each of the contactors has a semispherical contacting portion 67. The brush 60 is made of a metal having elastic forces. Therefore, the contactor 65 formed along a portion 66 surrounding the fixed portion 66 of the brush 60 serves as a plate spring having elastic forces which makes each of the contact portions 67 be pressure-contacted to each of fixed contacts 11 to 15. The brush 60 slides on the same circumference of the circle on which the fixed contacts 11 to 15 are formed according to an operational force on the lever 70, thereby bringing the brush 60 and the fixed contacts 11 to 15 into conduction.

Hereinafter, by referring to FIGS. 7 to 11, the contact between the brush 60 and fixed contacts 11 to 15 is described. In FIGS. 7 to 11, the contact portions 67, out of the other contact portions 67, which come into effective contact with any one of fixed contacts are shaded in black.

In the neutral position (A) shown in FIG. 7, the first contactor 61 and second conductor 62 of the brush 60 come into contact with the common contact 11. Other contactors 63 and 64 do not come into contact with any of the fixed contacts 11 to 15 including the individual contacts 12 to 15. This allows the rotary switch to be in an outputting position in an initial state.

When the lever 70 is rotated to the first stage clockwise (B) shown in FIG. 8, the contact between the first contactor 61 of the brush 60 and the common contact 11 is maintained, however, the contact between the second contactor 62 and the common contact 11 is cancelled. The non-contact between the third contactor 63 between any one of the fixed contacts 11 to 15 is maintained, however, the fourth contactor 64 comes into contact with the individual contact 12. This causes the common contact 11 and individual contact 12 to be brought into conduction through the brush 60, thus allowing the rotary switch to be in an outputting position at the first stage clockwise.

When the lever 70 is rotated to the second stage clockwise (C) shown in FIG. 9, the contact between the first contactor 61 of the brush 60 and the common contact 11 is maintained, however, the contact between the fourth contactor 64 and the individual contact 12 is cancelled. The non-contact between the third contactor 63 between any one of the fixed contacts 11 to 15 is maintained, however, the second contactor 62 comes into contact with the individual contact 14. This causes the common contact 11 and individual contact 14 to be brought into conduction through the brush 60, thus allowing the rotary switch to be in an outputting position at the second stage clockwise.

Hereinafter, operations at a time of a counterclockwise rotation by again returning to a neutral position (A) are described. When the lever 70 is rotated to the first stage counterclockwise (D) shown in FIG. 10, the contact between the second contactor 62 of the brush 60 and the common contact 11 is maintained, however, the contact between the first contactor 61 and the common contact 11 is cancelled.

The non-contact between the fourth contactor 64 and any one of the fixed contacts 11 to 15 is maintained, however, the third contactor 63 comes into contact with the individual contact 13. This causes the common contact 11 and individual contact 13 to be brought into conduction through the brush 60, thus allowing the rotary switch to be in an out position at the first stage counterclockwise.

When the lever 70 is rotated to the second stage counterclockwise (E) shown in FIG. 11, the contact between the second contactor 62 of the brush 60 and the common contact 11 is maintained, however, the contact between the third contactor 63 and the individual contact 13 is cancelled. The non-contact between the fourth contactor 64 and any one of the fixed contacts 11 to 15 is maintained, however, the first contactor 61 comes into contact with the individual contact 15. This causes the common contact 11 and individual contact 15 to be brought into conduction through the brush 60, thus allowing the rotary switch to be in an outputting position at the second stage counterclockwise.

As described above, the first contactor 61 of the brush 60 is a contactor offering two concurrent functions, one contacting the common contact 11 and another contacting the individual contact 15 at the second stage counterclockwise. Also, the second contactor 62 is a contactor offering two concurrent functions, one contacting the common contact 11 and another contacting the individual contact 14 at the second stage clockwise. The third contactor 63 is a contactor having a function of contacting the individual contact 13 at the first stage counterclockwise. The fourth contactor 64 is a contactor having a function of contacting the individual contact 12 at the first stage clockwise. These four contactors are formed on the circumference of the same circle. That is, by forming four contactors on the circumference of the same circle and by making contactors (61, 62) each having a function of contacting each of individual contactors (15, 14) at the second stage perform the concurrent function of contacting the common contact 11, miniaturization of the combined switch is achieved.

Conventionally, as shown in Patent Reference 1 or 2, by increasing the number of annular tracks in a diameter direction, fixed contacts of the rotary switch are arranged. However, according to the combined switch of the present invention, all contactors are placed on the circumference of the same circle. Therefore, an increase in size in a diameter direction can be suppressed.

Another Embodiment

Figure 12:
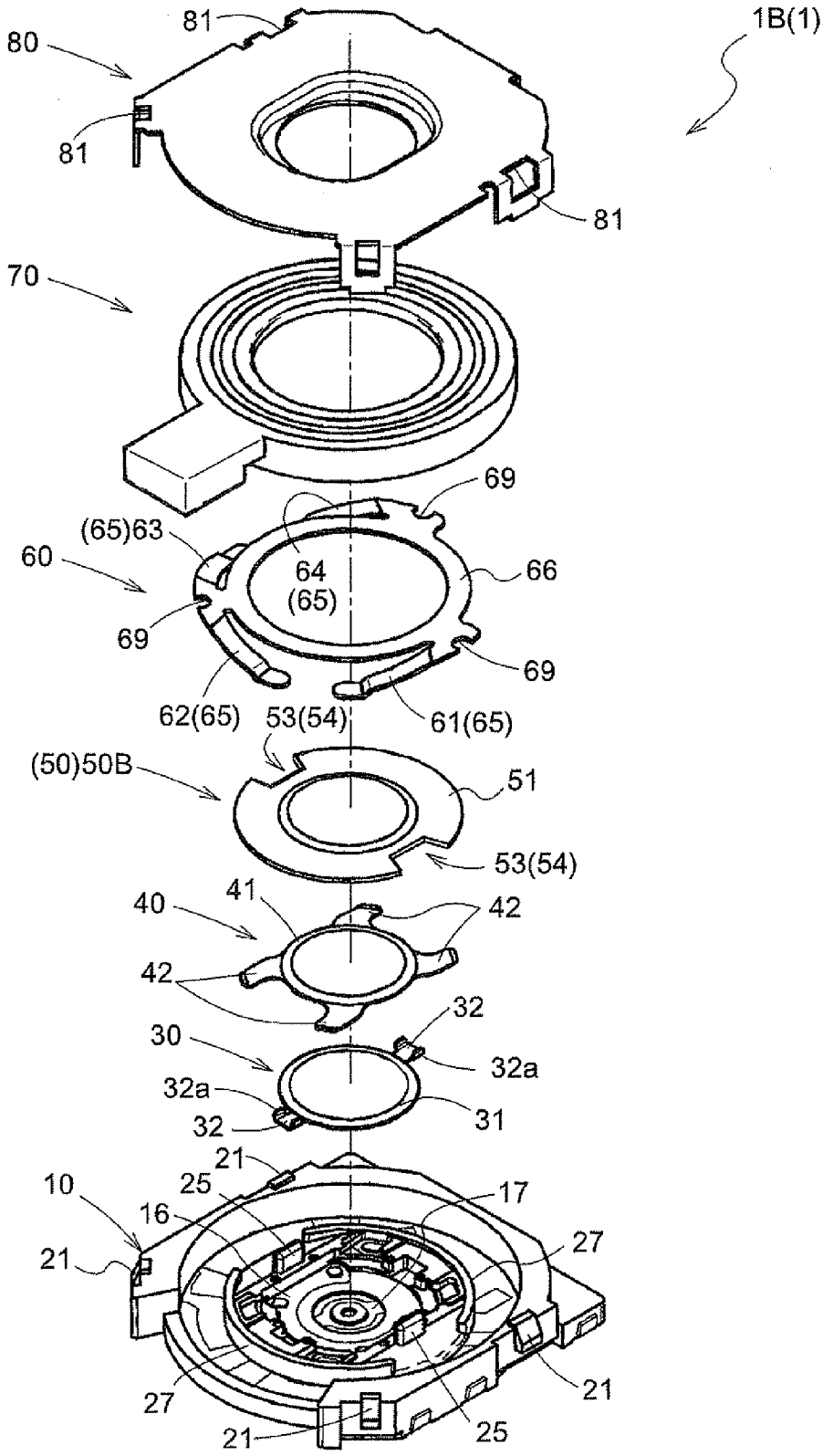
FIG. 12 is an exploded perspective view of a combined switch according to another embodiment of the present invention.

FIG. 12 is an exploded perspective view of a combined switch of another embodiment of the present invention. Configurations of the combined switch in FIG. 12 differ from those in FIG. 2 in that the insulating cover 50 (50B) has a different shape and configurations other than above are the same. Descriptions of only the insulating cover 50 are made accordingly.

In a portion 51 surrounding the insulating cover SOB in FIG. 12 are formed notches (concave portions) 53 serving as positioning portions 54. The ribs 25 of the main body portion 10 are mounted in positions corresponding to the notches 53. The insulating cover 50B is positioned by being guided by the ribs 25 which strikes the notches 53 to come into contact.

As described above, according to the present invention, the combined switch is provided which is capable of being easily assembled and realizing a smaller mounting area. It is understood by those skilled in the art that the above embodiments are merely examples and various changes and modifications may be made without departing from the spirit and scope of the present invention and such changes and modifications fall within the spirit and scope of the present invention.

Moreover, the combined switch of the present invention can be applied when the function of a photographic mode changing switch or zoom switch is integrated with the function of a shutter in, for example, a film camera, digital camera, or a like. By using the combined switch of the present invention, a mounting area can be decreased, which enables a camera to be made thin and small. The application of the combined switch of the present invention to cameras is one example and it is needless to say that the combined switch is applicable to other various products.

What is claimed is:

1. A combined switch realized by combining a push switch to be activated by a pressing operation and a rotary switch by a rotating operation comprising:

a main body portion having fixed contacts for said push switch and said rotary switch and housing movable contacts for said push switch and said rotary switch;

contact pairs for said push switch serving as said fixed contacts for said push switch mounted in a center of a bottom inside said main body portion;

a lower electrode plate serving as said fixed contacts for said push switch having elastic forces and being deformed at a time of a pressing operation to bring said contact pairs for said push switch into conduction;

an upper electrode plate serving as said movable contacts for said push switch having elastic forces and being deformed at a time of a pressing operation to be contactable to said lower electrode plate;

a lever for said rotary switch to receive rotating operating forces;

a plurality of contacts for said rotary switch serving as said fixed contacts for said rotary switch and enabling different connection according to rotating operations at least at two stages in both rotating directions from a neutral position of said lever and being formed on a circumference of a same circle outside said contact pairs for said push switch mounted on the bottom inside said main body portion;

a common contact configured as a contact for said rotary switch to be commonly connected in different connections according to rotating operations of said lever;

individual contacts configured as contacts for said rotary switch to be individually connected in different connections according to rotating operations of said lever; and a brush having a plurality of contactors sliding on a circumference of said same circle on which said contacts for said rotary switch are formed and being secured to said lever and serving as said movable contacts for said rotary switch to bring said common contact and said individual contacts into conduction according to a rotating operation on said lever.

2. The combined switch according to claim 1, wherein said brush has at least four said contactors corresponding to rotating operations at least at two stages in both rotating directions from a neutral position of said lever; and wherein two contactors out of said four contactors come into contact with corresponding individual contacts out of said individual contacts at a time of a rotating operation at a second stage in said both rotating directions and come into contact with said common contact at a time of a rotating operation at any other stage.

3. The combined switch according to claim 1, further comprising:

an insulating cover having positioning portions formed in a portion surrounding said insulating cover and being positioned when said positioning portions strike to come into contact with ribs formed in said main body portion to cover said upper electrode plate; and a frame to secure said insulating cover by interposing said insulating cover between said frame and said main body portion.

4. The combined switch according to claim 3, wherein said positioning portions are formed as slit-shaped incisions and are struck by said ribs passing through the incisions to come into contact with said ribs.

5. The combined switch according to claim 3, wherein said positioning portions are formed as notches being opened on a side of a portion surrounding said positioning portions and said ribs are struck by said notches to come into contact with said notches.

6. The combined switch according to claim 1, wherein said upper electrode plate is formed so as to extend from its peripheral portion and comprises leg portions electrically connected to a terminal formed in said main body;

wherein said brush comprises a circular annular fixed portion secured to said lever and supported by said main body, and contactors formed on the circumference and being in contact with contacts for said rotary switch; and wherein said leg portions of said upper electrode plate and said fixed portion are placed so as to overlap in a direction of a pressing operation on said push switch.

* * * * *